US005180878A

United States Patent [19]

Denchfield

[11] Patent Number: 5,180,878

[45] Date of Patent: Jan. 19, 1993

[54] GUNFIRE SIMULATOR

[75] Inventor: Clifford Denchfield, Ellington, England

[73] Assignee: Loral Europe Limited, Enfield, Great Britain

[21] Appl. No.: 845,181

[22] Filed: Mar. 3, 1992

[51] Int. Cl.[5] ..... F41A 33/00

[52] U.S. Cl. ..... 89/7; 42/55; 102/702; 434/16

[58] Field of Search ..... 446/398, 401, 405, 406; 434/16, 11; 42/55; 89/7; 102/363, 702; 116/23

[56] References Cited

U.S. PATENT DOCUMENTS

| | | | |
|---|---|---|---|
| 1,192,839 | 8/1916 | Armour | 89/7 |
| 1,237,157 | 8/1917 | Bellairs | 89/7 |
| 1,314,801 | 9/1919 | Hanzlik | 89/7 |
| 1,384,366 | 7/1921 | Welch | 89/7 |
| 2,094,854 | 10/1937 | Smith | 42/55 |
| 3,423,848 | 1/1969 | Ohlund | 434/16 |
| 3,938,272 | 2/1976 | Ditto et al. | 89/7 |
| 4,215,512 | 8/1980 | Philipson | 446/405 |
| 4,326,847 | 3/1982 | Roe | 434/12 |
| 4,654,008 | 3/1987 | Elmore | 89/7 |
| 4,662,844 | 5/1987 | Gallagher et al. | 42/55 |
| 4,664,631 | 5/1987 | Pederson et al. | 434/16 |

FOREIGN PATENT DOCUMENTS

| | | | |
|---|---|---|---|
| 405645 | 1/1934 | United Kingdom | 89/7 |
| 624405 | 6/1949 | United Kingdom | 89/7 |

*Primary Examiner*—David H. Brown
*Attorney, Agent, or Firm*—Mason, Fenwick & Lawrence

[57] ABSTRACT

A gunfire simulator has a combustion chamber, means for admitting fuel gas to the combustion chamber, inlet valve means for admitting oxygen or an oxygen containing gas to the combustion chamber, ignition means for igniting fuel gas in the combustion chamber, an exhaust port in the combustion chamber and outlet valve means for closing the exhaust port and arranged to open rapidly in response to a pressure rise within the combustion chamber. Preferably the outlet valve means comprises a frangible diaphragm, which may be clamped by its marginal portion in a breach block during combustion.

15 Claims, 3 Drawing Sheets

GUNFIRE SIMULATOR

DESCRIPTION

The invention relates to a gunfire simulator for use for example in gunnery or weapons training.

It is known to provide gunfire simulators which simulate the flash and noise of a gun being fired. At their simplest such gunfire simulators may be no more than blank cartridges which directly take the place of live ammunition. However for use in simulating the firing of battlefield weapons from small arms, through missile launchers to heavy guns such as tank guns and field artillery it is known to provide pyrotechnic devices which are housed in a metal block which may, for example, hold 12, 20 or 24 rounds and which is fixed to the exterior of the weapon platform close to the barrel of the weapon in question. Usually the weight of such devices is such that they cannot be fixed directly to the barrel of the weapon. Often the devices are sufficiently bulky to create an obstruction to the sight of the tank or gun crew. Since such devices are limited to a relatively small number of rounds, a lack of realism can result. Also the cost of the pyrotechnic devices, while being much less than that of live ammunition, is nevertheless appreciable.

It is an object of the invention to provide an improved gunfire simulator. It is a particular object of the invention to provide a battlefield gunfire simulator of reduced weight, of modest initial cost and high capacity and very low cost of operation.

According to the invention a gunfire simulator comprises a combustion chamber, means for admitting fuel gas to the combustion chamber, inlet valve means for admitting oxygen or an oxygen containing gas to the combustion chamber, ignition means for igniting fuel gas in the combustion chamber, an exhaust port in the combustion chamber and outlet valve means for closing the exhaust port and arranged to open rapidly in response to a pressure rise within the combustion chamber. In use the fuel gas in the combustion chamber will be ignited by the ignition means, which may comprise a spark plug, to cause an explosion of gases from the exhaust port resulting in noise and/or a flash which simulates gunfire.

The fuel gas admission means is preferably a device which precisely meters the amount of fuel admitted. The fuel gas admission means may be a solenoid valve.

The inlet valve means is preferably a flap valve which may comprise a resilient flap member. Means may be arranged to force air into the combustion chamber through the inlet valve and the means may comprise a fan or blower.

The valve means for closing the exhaust port preferably comprises a frangible diaphragm and preferably the diaphragm is clamped by its marginal portion in a breach block during combustion. Clamping may be effected by movement of one part of the breach block mechanism due to the pressure rise in the combustion chamber during combustion of the fuel gases. The one part of the breach mechanism may be biased into a breach-open position by resilient means which may for example be in the form of one or more elastomeric O rings.

The diaphragm may be a thin sheet of a material such as paper, plastics or metal. The diaphragm may be part of a web, tape or ribbon of the thin sheet material whereby a fresh portion of the sheet material may readily be presented to close the exhaust port after each explosion. Thus the apparatus may comprise means for indexing or feeding a fresh section of the web, tape or ribbon into the breach mechanism after each explosion. The tape may be contained on a spool or in a cassette.

The important feature of the exhaust valve is that the valve opens as rapidly as possible once the pressure in the combustion chamber has reached a given level. It has been discovered that an exhaust valve in the form of a frangible diaphragm is particularly effective in achieving the desired result.

If desired smoke generating materials may be injected into the combustion chamber to simulate the smoke associated with gunfire.

The means for igniting the fuel gas in the combustion chamber may be in the form of a generally conventional automotive spark ignition apparatus, or may comprise a piezo-electric device. Preferably the electrodes of the spark plug are extended so that the spark occurs centrally in the combustion chamber.

The combustion chamber is preferably generally cylindrical with the exhaust port at one axial end and the inlet valves for fuel gas and oxygen at the opposite axial end. The blower or fan may be contained in a cylindrical rearward extension to the combustion chamber for forcing air into the combustion chamber through the inlet valve.

The effective size of the exhaust port may be variable e.g. by means of a disc formed with a plurality of alternative apertures. Alternatively the exhaust port may be formed in a plate removably fixed to the combustion chamber, whereby the plate can be removed and replaced by a plate with a differently sized exhaust port. In this way the pitch and volume of sound generated by the simulator can be adjusted to match the characteristics of the weapon being simulated.

If desired more than one of the simulators may be arranged together for consecutive or simultaneous use, e.g. to simulate rapid fire weapons or to increase the volume of sound for large guns.

The invention is diagrammatically illustrated by way of example in the accompanying drawings in which.

Figure 1:
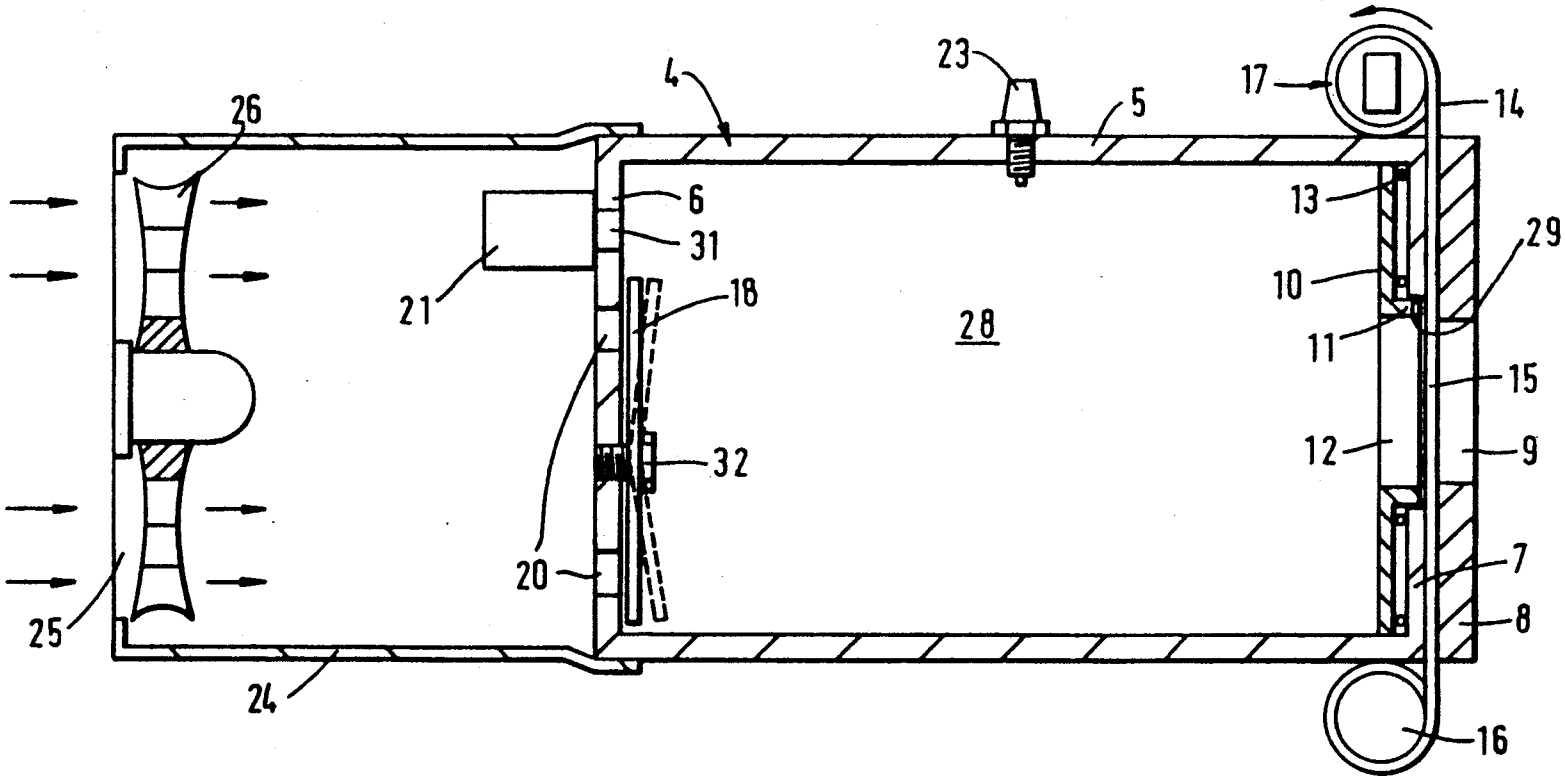
FIG. 1 is a sectional side elevation of a gunfire simulator.
Figure 2:
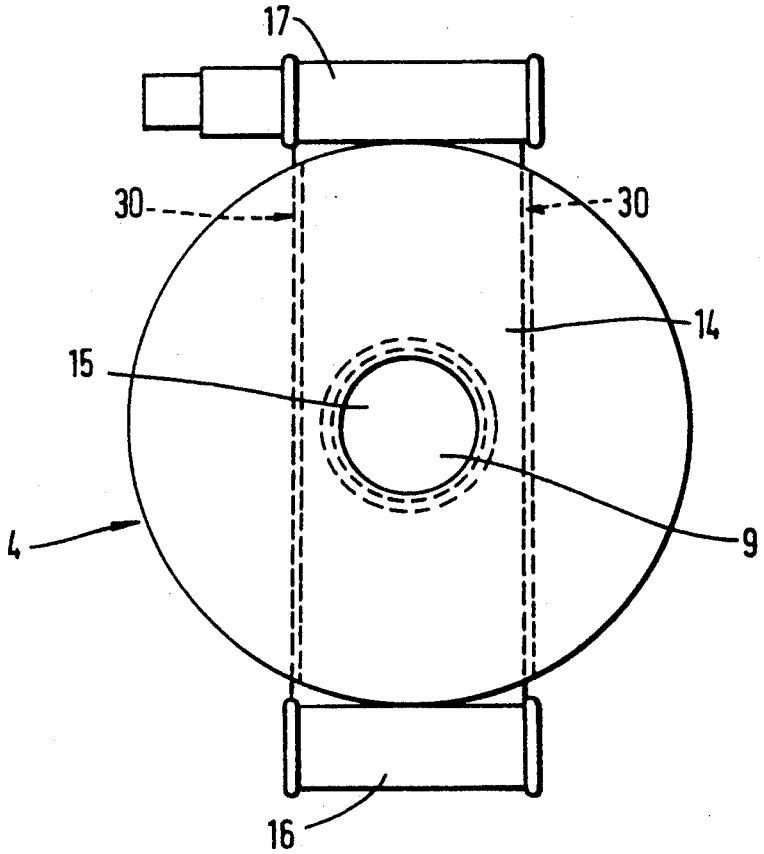
FIG. 2 is an end view of the simulator of FIG. 1.

In the drawings a gunfire simulator 4 intended for use in battlefield weapons training comprises a generally cylindrical combustion chamber 28 defined by a cylindrical wall 5 bounded by end walls 6 and 7 respectively. The cylindrical wall 5 carries a sparking plug 23 which projects into the chamber 28 and preferably its electrodes are extended into the combustion chamber so that ignition occurs centrally. The end wall 6 carries a gas solenoid valve 21 which communicates with the interior of the chamber 28 through an inlet port 31. The end wall 6 is also formed with air inlet ports 20 which communicate between atmosphere and the chamber 28. The ports 20 are controlled by a flap valve 18 disposed within the chamber 28 adjacent to the end wall 6 and in the form of a resilient disc of a material such as synthetic rubber clamped to the wall 6 by fastening means 32 to close the ports 20 as shown in full lines, but capable of assuming the position shown in dotted lines (FIG. 1) to allow air into the combustion chamber.

The end wall 7 of the combustion chamber is formed with a circular aperture 29 in which is mounted the spigot 11 of a spigot plate 10 which is sized to be a sliding fit within the combustion chamber. Resilient O-rings 13 are disposed between the spigot plate 10 and the end wall 7 of the combustion chamber to form a gas seal. The exterior surface of the end wall 7 carries a plate 8 formed with an aperture 9 which aligns with a corresponding aperture 12 in the spigot plate 10. A reel 16 of thin sheet material 14 is fed through a gap 30 between the plates 7 and 8 so as to cover the exhaust port of the combustion chamber defined by the apertures 12 and 9 respectively and is led onto a second reel 17. The portion 15 of the web of thin sheet material 14 which extends across the exhaust port thus forms a diaphragm for the purpose appearing hereinafter.

The end 6 of the combustion chamber is continued rearwardly by a generally cylindrical housing 24 formed with an open end 25 in which is mounted a fan or a blower 26 which is used to force air into the combustion chamber via the inlet ports 20.

In operation of the device fuel gas, e.g. a mixture of propane and butane, is admitted to the combustion chamber 28 through the gas valve 21 and combustion air is admitted to the combustion chamber through the ports 20. The fuel/air mixture is then ignited by means of the spark plug 23 so that pressure within the combustion chamber rises rapidly. This rise in pressure causes the inlet valve to close and the spigot plate 10 to move towards the end plate 7 so that the spigot 11 contacts the web 14 and clamps the web against the plate 8 at its portion surrounding the diaphragm 15. When the pressure reaches a given level the diaphragm will rupture to allow the combustion gases to escape thus causing the characteristic flash and bang of a fired weapon. The edge of the plate 8 surrounding the aperture 9 is preferably arranged to be sharp so that the diaphragm fractures around its edge and is removed cleanly as a disc. This ensures that the diaphragm, which acts as an exhaust valve, opens as quickly as possible to give a sharp report. After the combustion gases have vented to atmosphere the spigot plate moves back to its initial position whereupon the web of sheet material is unclamped and can then be indexed forward to bring a fresh portion of the web into position to cover the exhaust port. The fan or blower 26 preferably operates continuously so that when the pressure in the chamber drops, the inlet valve 18 opens so that air is admitted to the combustion chamber to purge the exhaust gases via the open exhaust port.

Figure 3:
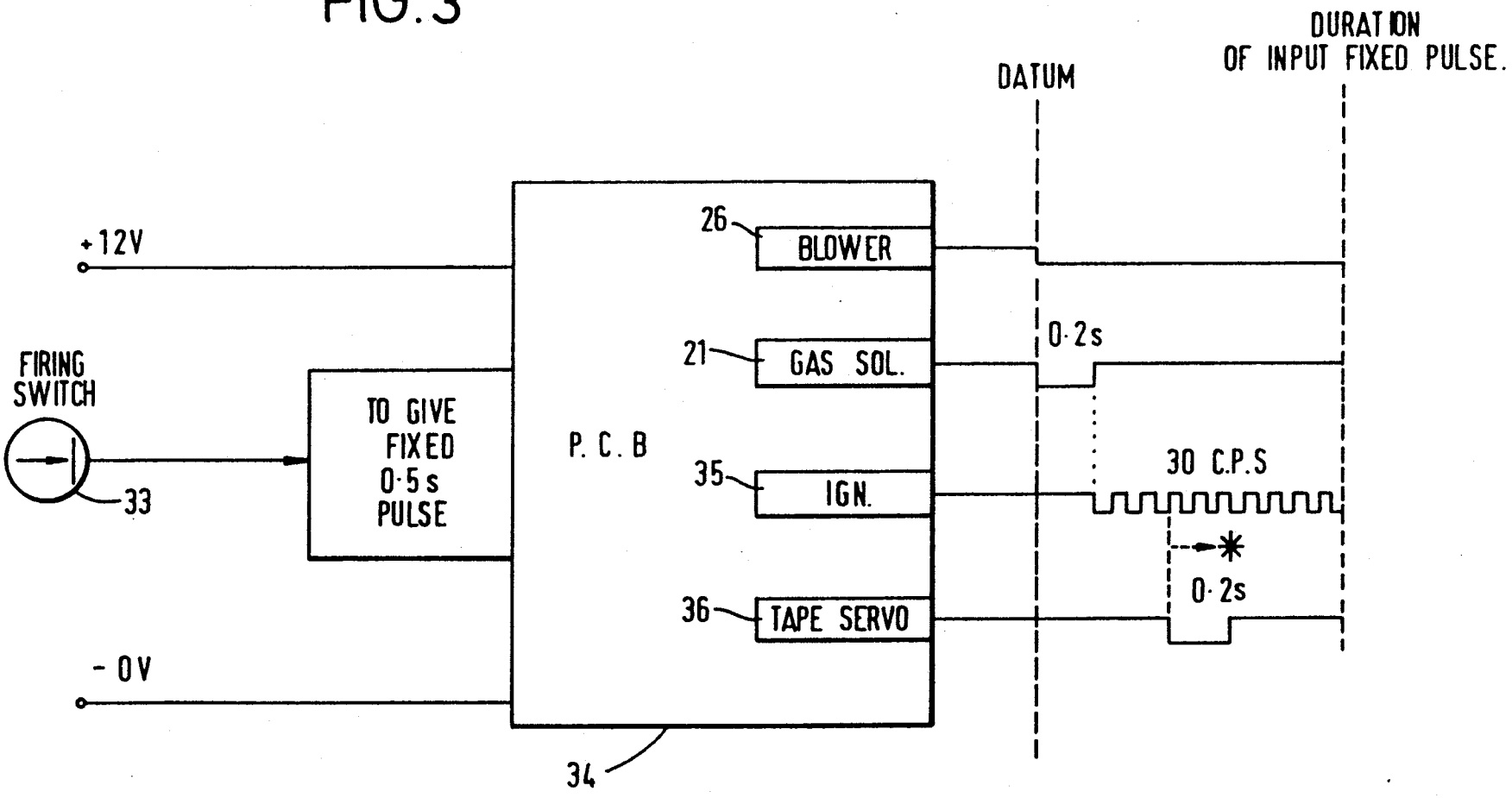
FIG. 3 is a block diagram showing the operating sequence.

The sequence of operations of the device is shown in FIG. 3 of the drawings.

In FIG. 3, it will be seen that when a firing switch 33 is depressed, a circuit board 34 provides a one half second pulse which causes the blower 26 to be activated and simultaneously the valve 21 operates for one quarter of a second to admit fuel into the combustion chamber. When the valve 21 closes, a spark ignition circuit 35 is actuated to deliver a spark or a series of sparks to the plug 23. Shortly afterwards, a tape servo mechanism 36 is actuated to bring a fresh portion of the web 14 into position to close the exhaust port.

By selecting and fitting an appropriately sized aperture plate 8 it is possible to change the pitch and volume of sound generated by the device to match the characteristics of the gun or other weapon being simulated.

It will be appreciated that it would be possible to arrange several of the simulators in bank so that they may be operated in the following modes:

(1) in unison where a maximum sound output is required, such for example, as to simulate a tank main armament gun;

(2) separately where a lower sound level is required e.g. as in the case of a smaller calibre gun or cannon, or (3) sequentially where both a reduced sound level and higher rate of fire is required as in the case of a machine gun or automatic weapon.

Where the simulators are arranged in bank they will be connected together so that any of the modes of operation can be selected as required by the weapons operator.

The invention thus provides a simple and effective weapon simulator the operational costs of which are much reduced as compared with known simulators using pyrotechnic devices.

I claim:

1. A gunfire simulator comprising a combustion chamber, means for admitting fuel gas to the combustion chamber, a flap valve for admitting air to the combustion chamber, means to force ambient air into the combustion chamber through the flap valve, ignition means for igniting fuel gas in the combustion chamber, an exhaust port in the combustion chamber, and outlet valve means for closing the exhaust port and arranged to open rapidly in response to a pressure rise within the combustion chamber.

2. A gunfire simulator according to claim 1, wherein the flap valve comprises a resilient flap member.

3. A gunfire simulator according to claim 1, wherein the means for igniting the fuel gas in the combustion chamber comprises automotive spark ignition apparatus.

4. A gunfire simulator according to claim 1, wherein the means for forcing ambient air into the combustion chamber is a blower.

5. A gunfire simulator according to claim 1, wherein the fuel gas admission means is a device which meters the amount of fuel admitted to the combustion chamber.

6. A gunfire simulator according to claim 5, wherein the fuel gas admission means is a solenoid valve.

7. A gunfire simulator according to claim 1, wherein the combustion chamber is generally cylindrical with the exhaust port at one axial end and with the fuel gas admission means and the flap valve at the opposite axial end.

8. A gunfire simulator according to claim 7, and further comprising a cylindrical rearward extension to the combustion chamber, said means for forcing ambient air into the combustion chamber being in said cylindrical extension.

9. A gunfire simulator according to claim 8, wherein the means for forcing ambient air into the combustion chamber is a blower.

10. A gunfire simulator according to claim 1, wherein the outlet valve means comprises a frangible diaphragm.

11. A gunfire simulator according to claim 10, and further comprising means for clamping the diaphragm during combustion.

12. A gunfire simulator according to claim 11, wherein the clamping means comprises a movable part movable to clamp the diaphragm due to a pressure rise in the combustion chamber during combustion of the fuel gas, and resilient means for biasing said movable part into a nonclamping position.

13. A gunfire simulator according to claim 10, wherein the diaphragm is a thin sheet of a material selected from the group consisting of paper, plastics and metal.

14. A gunfire simulator according to claim 13, wherein the diaphragm is part of a web of the thin sheet material which extends across the exhaust port and which is of greater width than the exhaust port, whereby the web may be moved to position a fresh portion of the sheet material to close the exhaust port after an explosion.

15. A gunfire simulator according to claim 14, comprising means for feeding a fresh portion of the web to the exhaust port after each explosion.

* * * * *